US010241468B2

(12) United States Patent
Uemura et al.

(10) Patent No.: US 10,241,468 B2
(45) Date of Patent: Mar. 26, 2019

(54) TONER CONTAINER ATTACHMENT DETECTING DEVICE AND IMAGE FORMING APPARATUS

(71) Applicant: KYOCERA Document Solutions Inc., Osaka (JP)

(72) Inventors: Shizuya Uemura, Osaka (JP); Tadaharu Kusumi, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 15/848,701

(22) Filed: Dec. 20, 2017

(65) Prior Publication Data

US 2018/0181059 A1 Jun. 28, 2018

(30) Foreign Application Priority Data

Dec. 27, 2016 (JP) ..... 2016-254401

(51) Int. Cl.

| | |
|---|---|
| ***G03G 21/18*** | (2006.01) |
| ***G03G 15/00*** | (2006.01) |
| ***G03G 21/16*** | (2006.01) |
| *G03G 15/06* | (2006.01) |

(52) U.S. Cl.

CPC ..... *G03G 21/1892* (2013.01); *G03G 15/80* (2013.01); *G03G 21/1657* (2013.01); *G03G 15/06* (2013.01); *G03G 21/1882* (2013.01); *G03G 2215/0697* (2013.01)

(58) Field of Classification Search

CPC ..... G03G 15/0863; G03G 15/0886; G03G 15/0872; G03G 2221/1823

See application file for complete search history.

(56) References Cited

U.S. PATENT DOCUMENTS

2007/0080786 A1* 4/2007 Kusumi ..... G03G 15/50 340/10.1
2011/0020039 A1* 1/2011 Mitsuishi ..... G03G 15/0872 399/262
2012/0321341 A1* 12/2012 Hori ..... G03G 15/0881 399/110

FOREIGN PATENT DOCUMENTS

JP 2003-271021 A 9/2003

* cited by examiner

*Primary Examiner* — Walter L Lindsay, Jr.
*Assistant Examiner* — Jessica L Eley
(74) *Attorney, Agent, or Firm* — IP Business Solutions, LLC

(57) ABSTRACT

A toner container attachment detecting device includes a reader-writer, a shutter made with an electrically conductive material and provided movably between an open position where the shutter is kept from influencing a carrier wave radiated from an antenna of the reader-writer and a covering position where the shutter influences the carrier wave, and first and second displacing portions. When the toner container is attached to an apparatus body, the first displacing portion displaces the shutter to the open position. When the toner container is removed from the apparatus body, the second displacing portion displaces the shutter to the covering position. A radio field intensity detecting section of the reader-writer detects a radio field intensity of the carrier wave and a determining section of the reader-writer determines, based on a detection result of the radio field intensity detecting section, whether or not the toner container is attached to the apparatus body.

10 Claims, 7 Drawing Sheets

TONER CONTAINER ATTACHMENT DETECTING DEVICE AND IMAGE FORMING APPARATUS

INCORPORATION BY REFERENCE

This application claims priority to Japanese Patent Application No. 2016-254401 filed on Dec. 27, 2016, the entire contents of which are incorporated by reference herein.

BACKGROUND

The present disclosure relates to toner container attachment detecting devices for detecting states of attachment/removal of toner containers and image forming apparatuses using the same and particularly relates to a technique for increasing the accuracy of detecting attachment/removal of a toner container.

In image forming apparatuses, such as a copier, for example, black, yellow, cyan, and magenta colored toners are used in order to form a multicolored image. Furthermore, in such an image forming apparatus, the toners of four colors are individually contained in separate toner containers removably attached to an apparatus body of the image forming apparatus and each toner is appropriately supplied from the associated toner container to a developing device according to a multicolor image to be formed.

Meanwhile, in the above image forming apparatus, predetermined toner information, including toner types used and toner levels in the toner containers, is managed by applying a wireless tag communication system using RFID (radio frequency identification). Specifically, in the image forming apparatus, the predetermined toner information is managed by attaching a tag to each toner container and using a reader-writer provided at the apparatus body to write the toner information on the tag and read it from the tag.

There is an example of a general toner container attachment detecting device that detects the state of attachment/removal of a toner container using the above wireless tag communication system applied to the management of toner information.

SUMMARY

A technique improved over the aforementioned technique is proposed as one aspect of the present disclosure.

A toner container attachment detecting device according to an aspect of the present disclosure is a toner container attachment detecting device for use in an image forming apparatus and includes a reader-writer, a shutter, a first displacing portion, and a second displacing portion.

The reader-writer is provided at an apparatus body of the image forming apparatus and performs data communication of predetermined toner information with a tag.

The shutter is made with an electrically conductive material and provided movably relative to the apparatus body between an open position where the shutter is kept from influencing a carrier wave radiated from an antenna of the reader-writer and a covering position where the shutter underlies across the antenna to influence the carrier wave radiated from the antenna.

The first displacing portion is provided on a toner container removably attachable to the apparatus body and capable of containing toner and displaces, upon attachment of the toner container to the apparatus body, the shutter from the covering position to the open position.

The second displacing portion displaces, upon removal of the toner container from the apparatus body, the shutter from the open position to the covering position.

The reader-writer includes the antenna, a carrier wave generating section, a radio field intensity detecting section, and a determining section.

The carrier wave generating section generates a carrier wave to be radiated from the antenna.

The radio field intensity detecting section detects a radio field intensity of the carrier wave radiated from the antenna.

The determining section determines, based on a detection result of the radio field intensity detecting section, whether or not the toner container is attached to the apparatus body.

A toner container attachment detecting device according to another aspect of the present disclosure is a toner container attachment detecting device for use in an image forming apparatus and includes a reader-writer, a tag, a shutter, a first displacing portion, and a second displacing portion.

The reader-writer is provided at an apparatus body of the image forming apparatus.

The tag is provided on a toner container removably attachable to the apparatus body and capable of containing toner and performs data communication of predetermined toner information with the reader-writer.

The shutter is made with an electrically conductive material and provided movably relative to the apparatus body between an open position where the shutter is kept from influencing a carrier wave radiated from an antenna of the reader-writer and a covering position where the shutter underlies across the antenna to influence the carrier wave radiated from the antenna.

The first displacing portion is provided on the toner container and displaces, upon attachment of the toner container to the apparatus body, the shutter from the covering position to the open position.

The second displacing portion displaces, upon removal of the toner container from the apparatus body, the shutter from the open position to the covering position.

The reader-writer includes the antenna, a carrier wave generating section, a radio field intensity detecting section, and a determining section.

The carrier wave generating section generates a carrier wave to be radiated from the antenna.

The radio field intensity detecting section detects a radio field intensity of the carrier wave radiated from the antenna.

The determining section determines, based on a detection result of the radio field intensity detecting section, whether or not the toner container is attached to the apparatus body.

An image forming apparatus according to still another aspect of the present disclosure includes an apparatus body, a toner container, and an attachment detecting device.

The toner container is removably attached to the apparatus body and is capable of containing toner.

The attachment detecting device detects whether or not the toner container is attached to the apparatus body.

The attachment detecting device used is the above-described toner container attachment detecting device.

The image forming apparatus further includes a control section and an image forming section.

The image forming section subjects a recording medium to image formation processing.

The control section controls, when accepting, as a determination result of the determining section of the reader-writer, that the toner container is attached to the apparatus body, to allow the image forming section to perform the image formation processing and controls, when accepting, as a determination result of the determining section of the reader-writer, that the toner container is removed from the apparatus body, to stop the image forming section from performing the image formation processing.

DETAILED DESCRIPTION

A description will be given below of a toner container attachment detecting device and an image forming apparatus, both according to an embodiment serving as one aspect of the present disclosure, with reference to the drawings.

Figure 1:
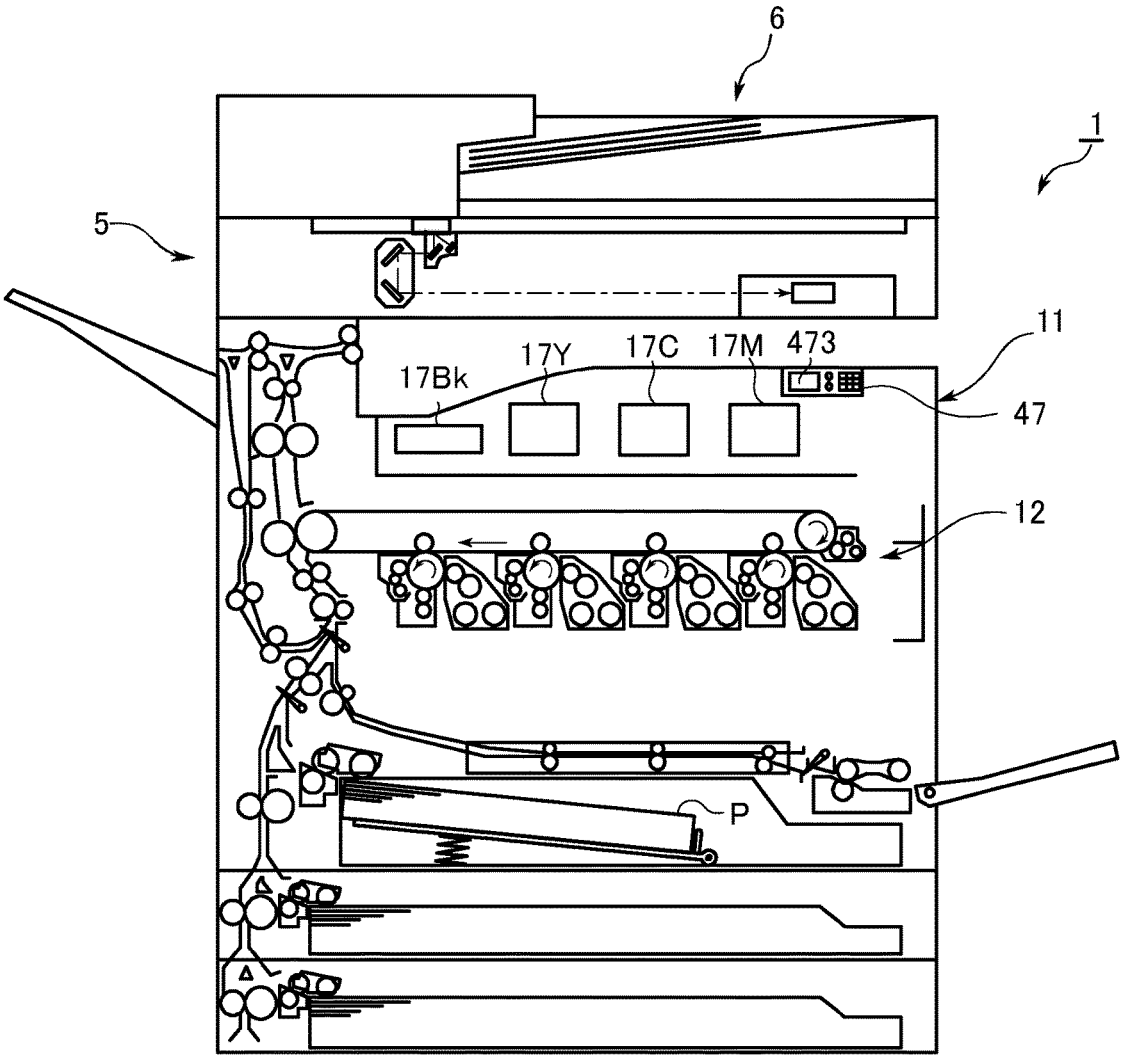
FIG. 1 is a schematic, partly cross-sectional front view showing the structure of an image forming apparatus according to the present disclosure.

FIG. 1 is a schematic, partly cross-sectional front view showing the structure of an image forming apparatus according to the present disclosure. The image forming apparatus 1 is a multifunction peripheral having multiple functions including, for example, a copy function, a print function, a scan function, and a facsimile function and is made up so that an apparatus body 11 thereof contains an operating section 47, a document feed section 6, a document reading section 5, and an image forming section 12.

The operating section 47 accepts operator's instructions for various types of operations and processing executable on the image forming apparatus 1, such as an instruction to perform an image forming operation and an instruction to perform a document reading operation, and includes a display section 473 that displays operation guidance and so on for the operator.

In the document reading operation of the image forming apparatus 1, the document reading section 5 optically reads an image of an original document being fed by the document feed section 6 and generates image data from the read image.

A description will be given below of the case where the image forming operation is performed on the image forming apparatus 1. The image forming section 12 forms a toner image on a paper sheet P serving as a recording paper sheet (recording medium) fed from a sheet feed section, based on image data generated by the above document reading operation, image data stored on an internal HDD of the image forming apparatus 1, image data received from a computer connected via a network, or other image data. In other words, the image forming section 12 subjects the recording medium to image formation processing.

The image forming section 12 is made up by including an image forming unit for black (Bk), an image forming unit for yellow (Y), an image forming unit for cyan (C), and an image forming unit for magenta (M). Furthermore, in the image forming section 12, the image forming units for different colors form respective toner images of the associated colors and these toner images of four colors are then synthesized to form a multicolor toner image. Then, in the image forming section 12, color printing (image formation) is achieved by fixing the formed multicolor toner image on the paper sheet P.

The image forming section 12 is provided with toner containers 17Bk, 17Y, 17C, and 17M containing toners for black, yellow, cyan, and magenta, respectively. These toner containers 17Bk, 17Y, 17C, and 17M are removably attached to the apparatus body 11 by their respective toner container attachment portions (not shown) provided at the apparatus body 11. In other words, each toner container 17Bk, 17Y, 17C, 17M is so attached to the apparatus body 11 as to be able to be inserted and pulled out in a direction perpendicular to the plane of FIG. 1. Furthermore, a toner container attachment detecting device 3 (see FIG. 3) according to this embodiment is applied to each of the toner containers 17Bk, 17Y, 17C, and 17M. When detecting the state of attachment/removal of the associated toner container 17Bk, 17Y, 17C, 17M, the toner container attachment detecting device 3 notifies the image forming apparatus 1 of the detection result (determination result), as will hereinafter be described in detail.

Figure 2:
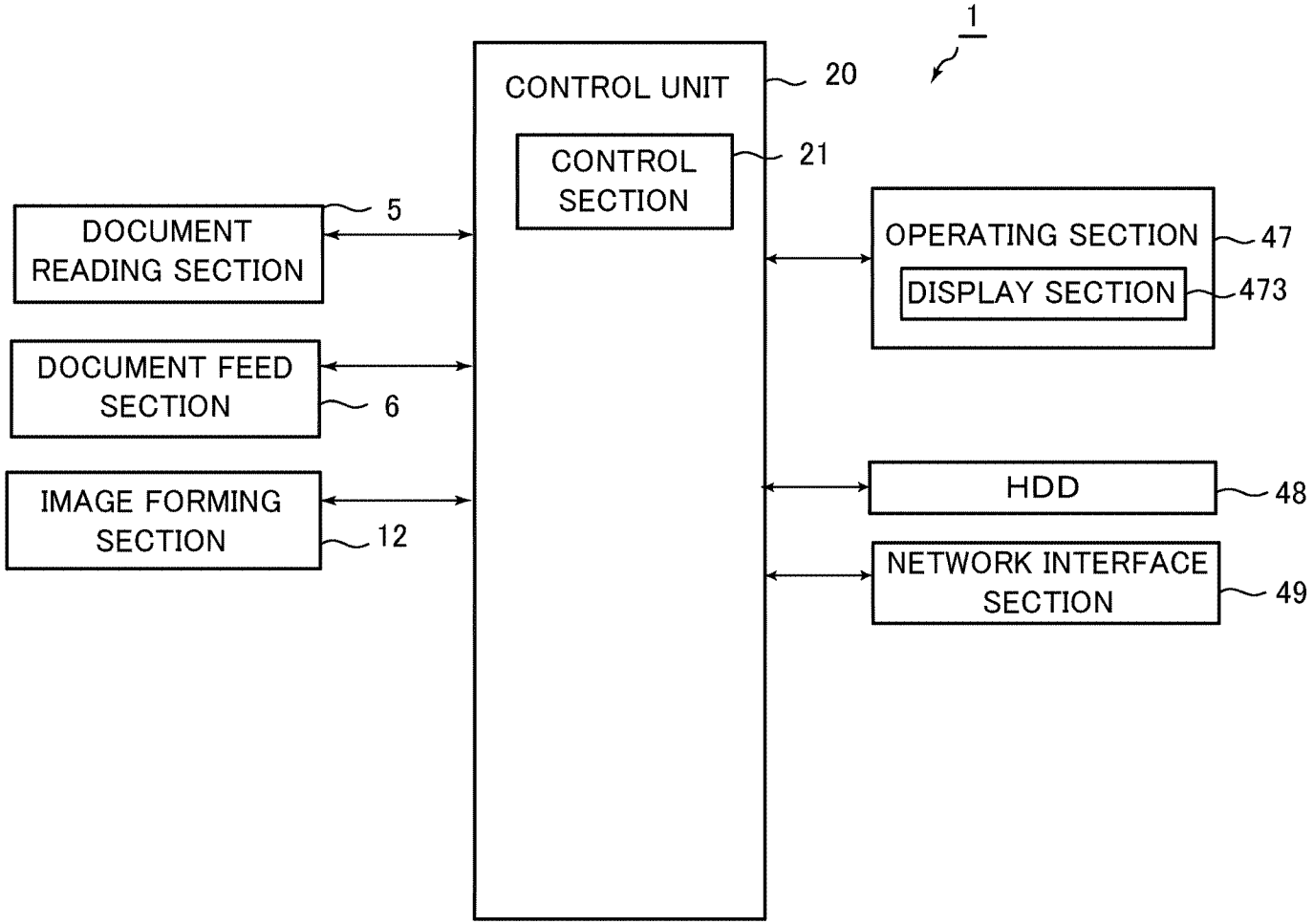
FIG. 2 is a functional block diagram schematically showing an essential internal configuration of the image forming apparatus shown in FIG. 1.

Next, a description will be given of the configuration of the image forming apparatus 1 with reference also to FIG. 2. FIG. 2 is a functional block diagram schematically showing an essential internal configuration of the image forming apparatus shown in FIG. 1.

The image forming apparatus 1 further includes a control unit 20, an HDD 48, and a network interface section 49.

The HDD (hard disc drive) 48 is a large storage device capable of storing document images read by the document reading section 5 or other data.

The network interface section 49 is formed of a communication module having a network communication function and transfers various data to and from personal computers, mobile information terminals or the like via the Internet or the like.

The control unit 20 is composed of a processor, a RAM (random access memory), a ROM (read only memory), and so on. The processor is, for example, a CPU (central processing unit), an MPU or an ASIC. The control unit 20 further includes a control section 21. Furthermore, when an image formation processing program stored on the HDD 48 or the like is executed by the above processor, the control unit 20 functions as the control section 21. However, the control section 21 may not be implemented by the operation of the control unit 20 in accordance with the image formation processing program but may be constituted by a hardware circuit.

Moreover, the control unit 20 is connected via unshown input/output ports to each of reader-writers 31 (see FIG. 3) included in the above toner container attachment detecting devices 3 to perform two-way data communication with the reader-writers 31.

The control section 21 governs the overall operation of the image forming apparatus 1 and is connected to the document reading section 5, the document feed section 6, the image forming section 12, the operating section 47, the HDD 48, the network interface section 49, and so on to control the operations of these components.

Furthermore, the control section 21 accepts a determination result from a determining section 317 (see FIG. 5) of each of the reader-writers 31. Specifically, the control section 21 accepts, from each of the determining sections 317 of the reader-writers 31 of the four toner container attachment detecting devices 3 provided separately for the toner containers 17Bk, 17Y, 17C, and 17M, a determination result of whether or not the associated toner container 17Bk, 17Y, 17C, 17M is attached to the apparatus body 11.

When accepting, as determination results from the determining sections 317 of the reader-writers 31, that the toner containers are attached to the apparatus body 11, the control section 21 allows the image forming section 12 to perform image formation processing. On the other hand, when accepting, as a determination result from any of the determining sections 317 of the reader-writers 31, that the associated toner container is removed from the apparatus body 11, the control section 21 stops the image forming section 12 from performing image formation processing.

More specifically, only when accepting from all the four determining sections 317 that all the associated toner containers 17Bk, 17Y, 17C, and 17M are attached to the apparatus body 11, the control section 21 allows the image forming section 12 to perform the image formation processing. On the other hand, when accepting from at least one determining section 317 that the associated toner container 17Bk, 17Y, 17C or 17M is removed from the apparatus body 11, the control section 21 stops the image forming section 12 from performing the image formation processing.

Moreover, the control section 21 allows the display section 473 to display the accepted determination results. Specifically, the control section 21 allows the display section 473 to display the states of attachment/removal of the toner containers 17Bk, 17Y, 17C, and 17M. Furthermore, when allowing the display section 473 to display that at least one toner container 17Bk, 17Y, 17C or 17M is removed from the apparatus body 11, the control section 21 also allows the display section 473 to display that the image formation processing cannot be executed in the image forming section 12.

Figure 3:
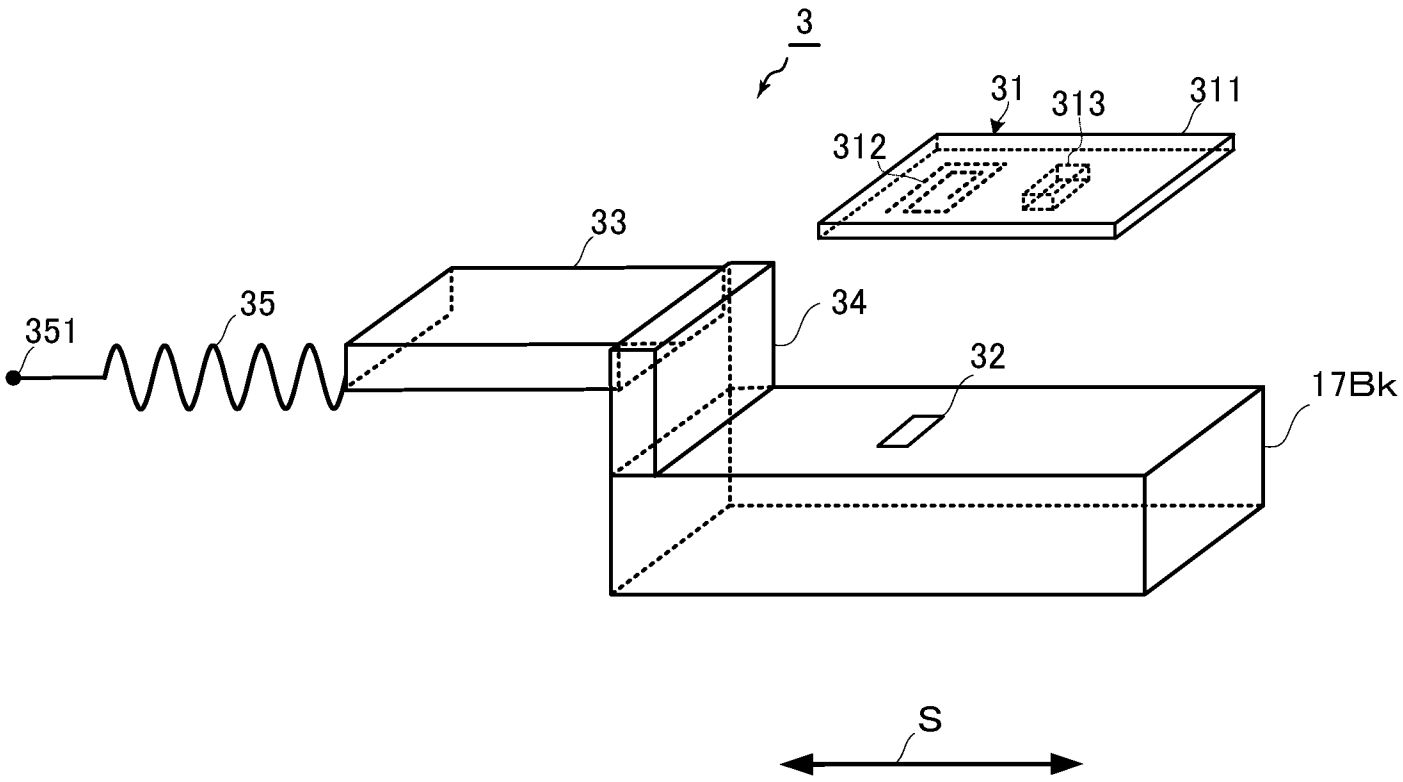
FIG. 3 is a view for illustrating the structure of essential parts of a toner container attachment detecting device according to one embodiment of the present disclosure.

Next, a description will be given in detail of the toner container attachment detecting device 3 according to this embodiment with reference to FIG. 3. FIG. 3 is a view for illustrating the structure of essential parts of the toner container attachment detecting device according to one embodiment of the present disclosure. The following description is given taking as an example the toner container attachment detecting device 3 applied to the toner container 17Bk.

The toner container attachment detecting device 3 according to this embodiment includes the reader-writer 31, a tag 32, a shutter 33, an abutment member 34, and an urging member 35. Furthermore, when the toner container 17Bk is attached to the apparatus body 11 (see FIG. 1) as illustrated in FIG. 3, the toner container attachment detecting device 3 has a structure in which an antenna 312 of the reader-writer 31 and the tag 32 face each other. The reader-writer 31 and the tag 32 constitute a wireless tag communication system using RFID (radio frequency identification), which enables two-way data communication.

The reader-writer 31 is provided at the apparatus body 11. Specifically, the reader-writer 31 includes a printed circuit board (RFID board) 311, and the antenna 312 and an IC chip 313 both provided on the printed circuit board 311. The IC chip 313 is a chip on which components of the reader-writer 31 other than the antenna 312 are integrated. The reader-writer 31 is provided at the apparatus body 11 by mounting the printed circuit board 311 to the apparatus body 11 so that the antenna 312 and the tag 32 face each other with a predetermined distance (for example, 5 mm) in between.

The tag 32 is provided on the toner container 17Bk in such a manner that it is secured through a securing portion, such as an adhesive, on a surface of the toner container 17Bk.

Furthermore, in the toner container attachment detecting device 3 according to this embodiment, the reader-writer 31 and the tag 32 are used not only for detection of attachment/removal of the toner container 17Bk but also for management of toner information. Specifically, the tag 32 performs, with the reader-writer 31, data communication of predetermined toner information, including the toner type used and toner level in the toner container 17Bk. More specifically, in the image forming apparatus 1 according to this embodiment, toner information is transferred between the reader-writer 31 and the tag 32 based on the output of an instruction signal from the control section 21 to a below-described control section of the reader-writer 31. This toner information is also transferred between the control section 21 and the reader-writer 31. The control section 21 allows a storage section (not shown) in the apparatus body 11 to store the received toner information. In this manner, the toner information is managed.

Since, as just described, the toner container attachment detecting device 3 according to this embodiment uses the reader-writer 31 and the tag 32 for the purposes of detection of attachment/removal of the toner container 17Bk and management of toner information, the structure of the image forming apparatus 1 can be simplified and simultaneously the cost can be reduced. Specifically, since, in the toner container attachment detecting device 3 according to this embodiment, the reader-writer 31 and the tag 32 for the purpose of detection of attachment/removal of the toner container 17Bk are also used for the purpose of management of toner information, this makes it possible to eliminate the need to provide any sensor (detection switch) for detecting the state of attachment/removal of the toner container 17Bk. Furthermore, it is possible to dispense with signal lines connecting the control unit 20 and the above sensor and the previously described input/output ports connected with the signal lines, which makes it possible to make up an image forming apparatus 1 having a simple structure at low cost.

The shutter 33 is made with an electrically conductive material, such as metal or electrically conductive resin. Furthermore, the shutter 33 is so formed as to be slidable in the apparatus body 11 in the right-and-left directions in FIG. 3 (shown by the double-headed arrow in FIG. 3) through an unshown support mechanism provided in the apparatus body 11. Moreover, according to operations for attachment and removal of the toner container 17Bk in which the toner container 17Bk is attached to and removed from the apparatus body 11 by the movement in the right and left directions, the shutter 33 slides between an open position and a covering position which will be described hereinafter.

The abutment member 34 is provided on the toner container 17Bk in such a manner that it is secured, for example, through an adhesive, to an end (left end in FIG. 3) of the surface of the toner container 17Bk in a direction of insertion of the toner container 17Bk. Specifically, the abutment member 34 is provided at a location on the toner container 17Bk where the abutment member 34 abuts on the shutter 33 when the toner container 17Bk is attached to the apparatus body 11. Furthermore, the abutment member 34 is, like the toner container 17Bk, made with a non-electrically conductive material, such as synthetic resin, to keep from influencing data communication between the reader-writer 31 and the tag 32 (a carrier wave radiated from the reader-writer 31). Moreover, as will hereinafter be described in detail, when the toner container 17Bk is attached to the apparatus body 11, the abutment member 34 displaces the shutter 33 from the covering position to the open position. This abutment member 34 is an example of the first displacing portion defined in "What is claimed is".

The urging member 35 is formed of, for example, a pressure spring, such as a compressed coil spring, made of metal. Furthermore, the urging member 35 is anchored at unshown one end to the shutter 33 and anchored at the other end 351 to the apparatus body 11. Thus, the urging member 35 normally urges the shutter 33 toward the reader-writer 31 (to the right in FIG. 3) and the shutter 33 is grounded through the urging member 35 on the apparatus body 11 side. Moreover, the urging member 35 urges the shutter 33 toward the covering position where the shutter 33 faces the antenna 312 of the reader-writer 31 when the toner container 17Bk is removed from the apparatus body 11. As will be hereinafter described in detail, when the toner container 17Bk is removed from the apparatus body 11, the urging member 35 displaces the shutter 33 from the open position to the covering position. This urging member 35 is an example of the second displacing portion defined in "What is claimed is".

Figure 4A:
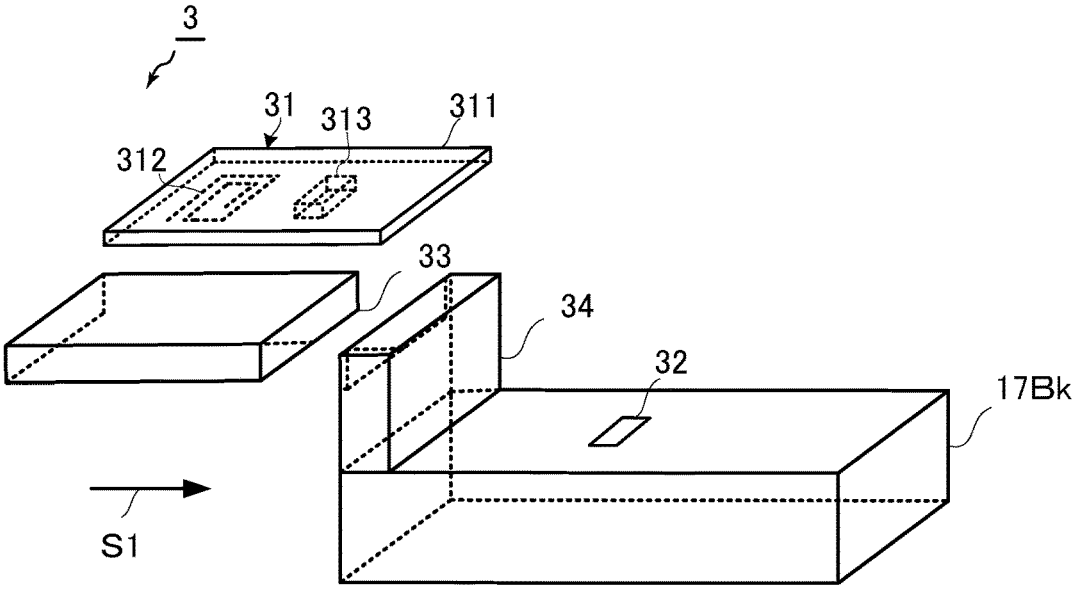
FIGS. 4A and 4B are views for illustrating operating states of the shutter shown in FIG. 3 and show the shutter in a covering position and the shutter in an open position, respectively.
Figure 4B:
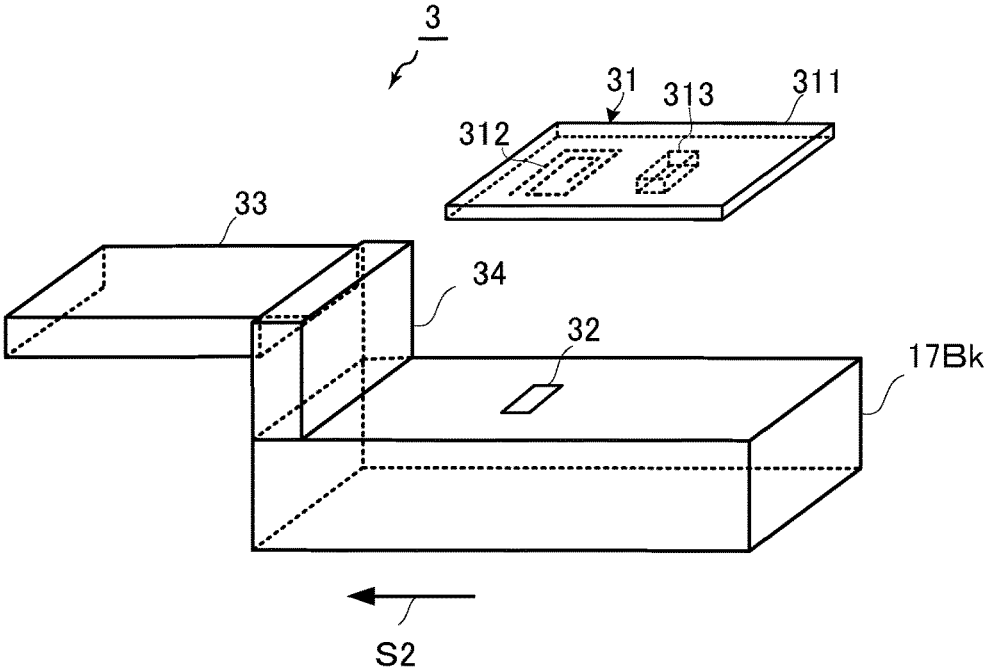

Next, a description will be given in detail of the open position and covering position of the shutter 33 with reference also to FIGS. 4A and 4B. FIGS. 4A and 4B are views for illustrating operating states of the shutter shown in FIG. 3 and show the shutter in the covering position and the shutter in the open position, respectively. In FIGS. 4A and 4B, the urging member 35 is not given.

As shown in FIG. 4A, the shutter 33 being in the covering position means that the toner container 17Bk has been moved in the direction of the arrow S1 in FIG. 4A and removed from the apparatus body 11 and that the shutter 33 is maximally urged by the urging member 35. In addition, the shutter 33 is stopped at the covering position so that it is movable in a direction opposite to the direction of the arrow S1 in FIG. 4A against an urging force of the urging member 35.

Furthermore, when in the covering position, the shutter 33 is disposed to underlie across the entire antenna 312 of the reader-writer 31. Therefore, when in the covering position, the shutter 33 influences a carrier wave radiated from the antenna 312 of the reader-writer 31. Specifically, since the shutter 33 is made with an electrically conductive material as described above, the shutter 33 in the covering position absorbs (interrupts) magnetic flux lines of a carrier wave radiated from the antenna 312 to reduce the radio field intensity (output level) of the carrier wave.

When, in the state where the shutter 33 is in the covering position, the toner container 17Bk is attached to the apparatus body 11, the shutter 33 slides in the direction opposite to the direction of the arrow S1 against the urging force of the urging member 35 and finally stops at the open position shown in FIG. 4B. Specifically, when an operation for attachment of the toner container 17Bk to the apparatus body 11 is performed by sliding the toner container 17Bk in the direction opposite to the direction of the arrow S1, the abutment member 34 abuts on the shutter 33 and slides the shutter 33 from the covering position to the open position according to the above operation for attachment of the toner container 17Bk and against the urging force of the urging member 35.

As shown in FIG. 4B, the shutter 33 being in the open position means that the toner container 17Bk has been moved in the direction of the arrow S2 in FIG. 4B and attached to the apparatus body 11, in which case the shutter 33 is stopped at the open position by abutting on the abutment member 34. Specifically, the shutter 33 abuts on the abutment member 34 provided on the toner container 17Bk while it is urged to move in a direction opposite to the direction of the arrow S2 in FIG. 4B by the urging force of the urging member 35. In addition, when the toner container 17Bk is attached to the above-described toner container attachment portion, the toner container 17Bk is secured by an unshown engagement mechanism provided at the apparatus body 11. Therefore, the shutter 33 abutting on the abutment member 34 is also stopped at the open position against the urging force of the urging member 35.

Furthermore, when in the open position, the shutter 33 is disposed a predetermined distance apart from the antenna 312 of the reader-writer 31. Therefore, when in the open position, the shutter 33 does not influence a carrier wave radiated from the antenna 312 of the reader-writer 31.

When, in the state where the shutter 33 is in the open position, the toner container 17Bk is removed from the apparatus body 11, the shutter 33 slides in the direction opposite to the direction of the arrow S2 by the urging force of the urging member 35 and finally stops at the covering position shown in FIG. 4A. Specifically, when an operation for removal of the toner container 17Bk from the apparatus body 11 is performed by releasing the lock (engagement) of the engagement mechanism to slide the toner container 17Bk in the direction of the arrow S1, the urging member 35 slides the shutter 33 abutting on the abutment member 34 from the open position to the covering position according to the operation for removal of the toner container 17Bk.

Figure 5:
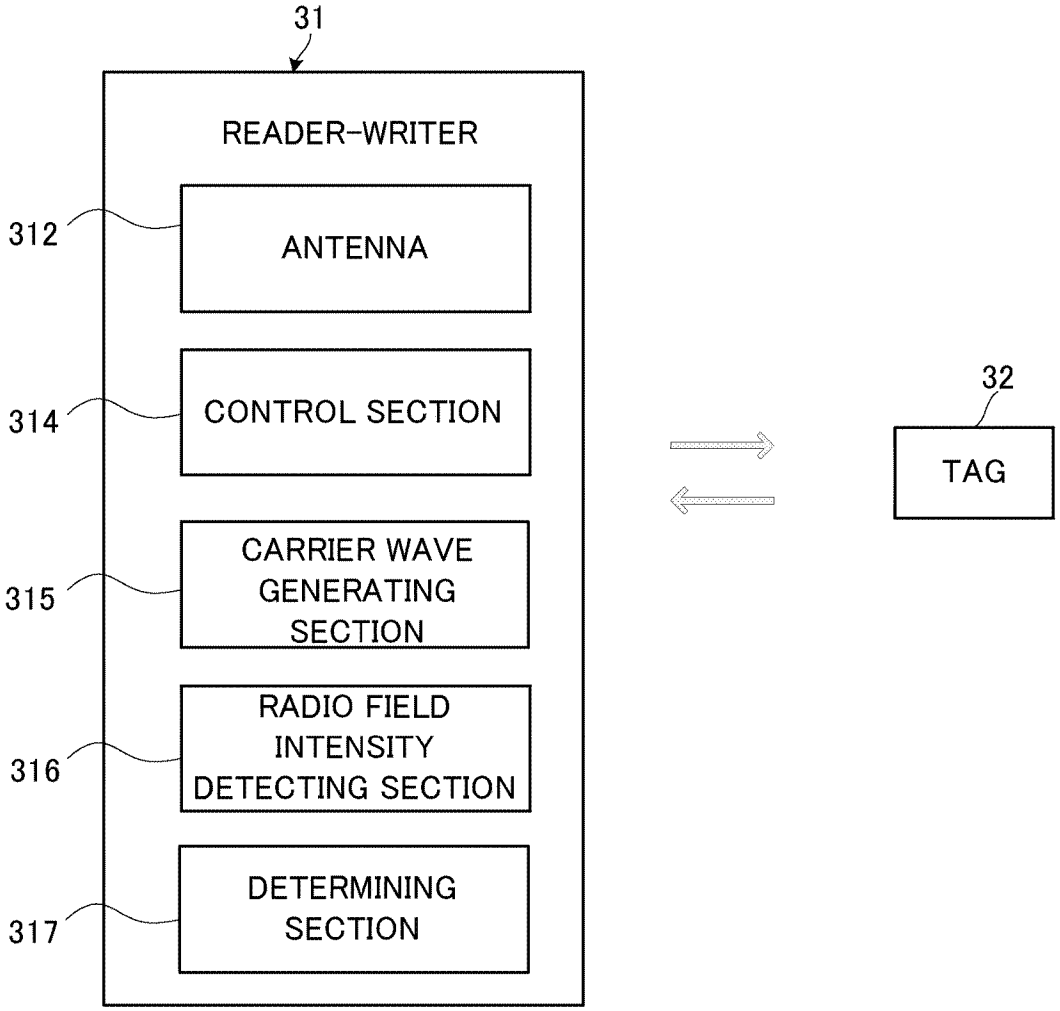
FIG. 5 is a block diagram showing an essential configuration of a reader-writer and a tag both shown in FIG. 3.

Next, a description will be given in detail of the reader-writer 31 with reference to FIG. 5. FIG. 5 is a block diagram showing an essential configuration of the reader-writer and the tag shown in FIG. 3.

The reader-writer 31 includes the antenna 312, a control section 314, a carrier wave generating section 315, a radio field intensity detecting section 316, and a determining section 317 and performs data communication with the tag 32, for example, by an electromagnetic induction method. Furthermore, as described previously, the components of this reader-writer 31, including the control section 314, the carrier wave generating section 315, the radio field intensity detecting section 316, and the determining section 317, are integrated on the IC chip 313. Moreover, the reader-writer 31 performs two-way data communication through an unshown sending/receiving section with the control unit 20 of the image forming apparatus 1.

The control section 314 is composed of a processor, for example, a CPU (central processing unit), an MPU or an ASIC and governs the overall operation of the reader-writer 31.

The antenna 312 sends (radiates) to the tag 32 a carrier wave generated by the carrier wave generating section 315 and receives a subcarrier from the tag 32. Furthermore, the antenna 312 also receives the carrier wave radiated from the antenna 312 (allows the carrier wave to be entered thereinto).

The carrier wave generating section 315 generates, based on an instruction signal from the control section 314, a carrier wave to be radiated from the antenna 312.

The radio field intensity detecting section 316 detects the radio field intensity (output level) of the carrier wave radiated from the antenna 312. Specifically, the radio field intensity detecting section 316 includes a magnetic flux density meter (not shown) for detecting the magnetic flux density (the number of magnetic flux lines) of a carrier wave entering the antenna 312 and detects, as the radio field intensity of the carrier wave, the magnetic flux density acquired by the magnetic flux density meter.

The determining section 317 determines, based on the detection result of the radio field intensity detecting section 316, whether or not the toner container 17Bk is attached to the apparatus body 11. Specifically, when the radio field intensity of the carrier wave detected by the radio field intensity detecting section 316 is larger than a predetermined threshold value, the determining section 317 determines that the toner container 17Bk is attached to the apparatus body 11. On the other hand, when the radio field intensity of the carrier wave detected by the radio field intensity detecting section 316 is equal to or smaller than the predetermined threshold value, the determining section 317 determines that the toner container 17Bk is removed from the apparatus body 11. Then, the determining section 317 sends the determination result via the sending/receiving section to the control unit 20 of the image forming apparatus 1. Thus, in the control unit 20, the control section 21 accepts the determination result from the determining section 317 and allows the display section 473 to display the determination result accepted by the control section 21 in the control unit 20, which enables the user or the like on the image forming apparatus 1 side to visually recognize the state of attachment/removal of the toner container 17Bk.

Figure 6A:
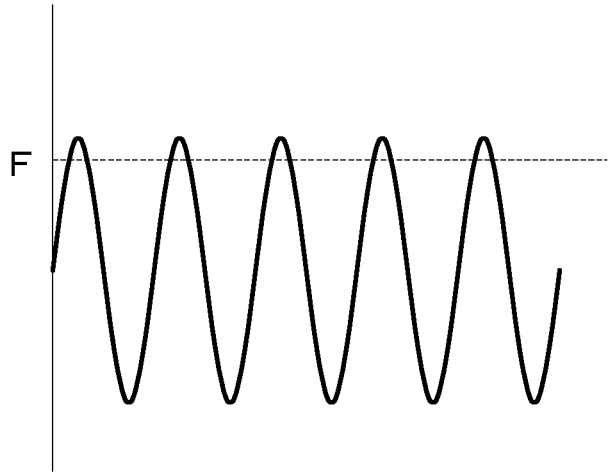
FIGS. 6A and 6B are graphs for illustrating detection results of a radio field intensity detecting section shown in FIG. 5 when the shutter is in the open position and the covering position, respectively.
Figure 6B:
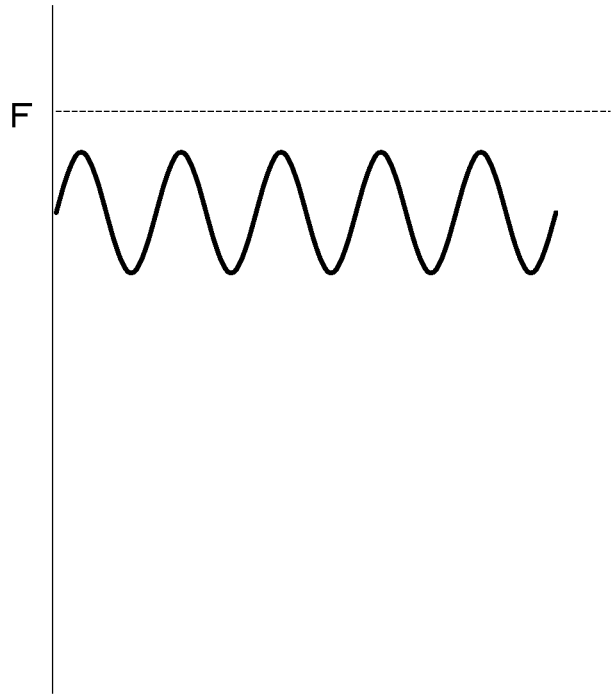

Next, a description will be given in detail of the determination operation in the determining section 317 with reference also to FIGS. 6A and 6B. FIGS. 6A and 6B are graphs for illustrating detection results of the radio field intensity detecting section shown in FIG. 5 when the shutter is in the open position and the covering position, respectively.

When in the open position, the shutter 33 is not located in front of the antenna 312 as shown in FIG. 4B, so that the magnetic flux lines of a carrier wave radiated from the antenna 312 are not absorbed by the shutter 33. Therefore, a carrier wave of a waveform shown in FIG. 6A is incident on the antenna 312 and the radio field intensity (output level) of the incident carrier wave is detected by the radio field intensity detecting section 316. Furthermore, the determining section 317 determines that, as shown in FIG. 6A, the radio field intensity of the carrier wave detected by the radio field intensity detecting section 316 is larger than the predetermined threshold value F and, thus, determines that the toner container 17Bk is attached to the apparatus body 11. Then, the determining section 317 sends this determination result through the sending/receiving section to the control unit 20 of the image forming apparatus 1.

On the other hand, when in the covering position, the shutter 33 is located in front of the antenna 312 to underlie across it as shown in FIG. 4A, so that the magnetic flux lines of a carrier wave radiated from the antenna 312 are absorbed by the shutter 33. Therefore, a carrier wave of a waveform shown in FIG. 6B is incident on the antenna 312 and the radio field intensity (output level) of the incident carrier wave is detected by the radio field intensity detecting section 316. Furthermore, the determining section 316 determines that, as shown in FIG. 6B, the radio field intensity of the carrier wave detected by the radio field intensity detecting section 316 is smaller than the predetermined threshold value F and, thus, determines that the toner container 17Bk is removed from the apparatus body 11. Then, the determining section 317 sends this determination result through the sending/receiving section to the control unit 20 of the image forming apparatus 1.

As thus far described, in the toner container attachment detecting device 3 according to this embodiment, the shutter 33 is made with an electrically conductive material. Furthermore, when the toner container 17Bk is attached to the apparatus body 11, the shutter 33 is displaced, by the abutment member (first displacing portion) 34, to the open position where the shutter 33 does not influence the carrier wave radiated from the antenna 312. On the other hand, when the toner container 17Bk is removed from the apparatus body 11, the shutter 33 is displaced, by the urging member (second displacing portion) 35, to the covering position where the shutter 33 influences the carrier wave radiated from the antenna 312. Moreover, the radio field intensity detecting section 316 detects the radio field intensity of the carrier wave radiated from the antenna 312 and the determining section 317 determines, based on the detection result of the radio field intensity detecting section 316, whether or not the toner container 17Bk is attached to the apparatus body 11. Therefore, the toner container attachment detecting device 3 according to this embodiment, unlike the above-described general example (the above-described general attachment detecting device), can improve the accuracy of detecting the state of attachment/removal of the toner container.

Specifically, unlike the above general example where the state of attachment/removal of the toner container is detected based on whether or not the reader-writer and the tag can establish data communication, in the toner container attachment detecting device 3 according to this embodiment, the determining section 317 detects the state of attachment/removal of the toner container based on the detection result of the radio field intensity detecting section 316 which changes depending on the stopping position (the open position or the covering position) of the shutter 33. As a result, unlike the above general example, the toner container attachment detecting device 3 according to this embodiment can accurately detect that the toner container 17Bk is attached to the apparatus body 11, even if the tag 32 is peeled off from the toner container 17Bk. More specifically, since the shutter 33 is located at the open position while the toner container 17Bk is attached to the apparatus body 11, the determining section 317 determines, in spite of the presence or absence of the tag 32, that the radio field intensity of the carrier wave detected by the radio field intensity detecting section 316 is larger than the predetermined threshold value F. Therefore, the determining section 317 can accurately determine that the toner container 17Bk is attached to the apparatus body 11.

Furthermore, unlike the above general example, the toner container attachment detecting device 3 according to this embodiment can avoid, even in the case where a toner container according to a comparative example without the abutment member 34 is used, a wrong determination that the toner container is not attached to the apparatus body.

Figure 7:
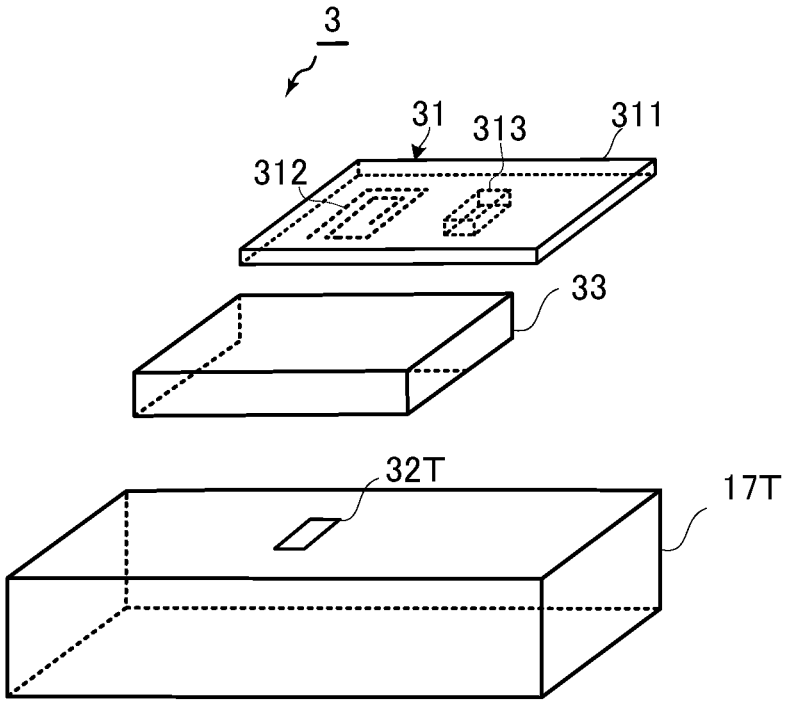
FIG. 7 is a view for illustrating an operation of the toner container attachment detecting device shown in FIG. 3 when a toner container which is a comparative example is used.

Specifically, when as shown in FIG. 7 the toner container 17T according to the comparative example is attached to the apparatus body 11, unlike the toner container according to this embodiment, the shutter 33 stays at the covering position without moving from the covering position to the open position because the toner container 17T is not provided with the abutment member 34. Therefore, in spite of the presence or absence of the tag 32T on the toner container 17T, the determining section 317 determines that the radio field intensity of the carrier wave detected by the radio field intensity detecting section 316 is equal to or smaller than the predetermined threshold value F and, therefore, can determine that the toner container 17T is removed from the apparatus body 11. As just described, in the toner container attachment detecting device 3 according to this embodiment, when the toner container 17T according to the comparative example is attached to the apparatus body 11, it is determined that the toner container 17T is not attached to the apparatus body 11. In other words, the toner container attachment detecting device 3 according to this embodiment can accurately determine, only for the toner container 17Bk with the abutment member 34, its state of attachment/removal.

As seen from the above, in the toner container attachment detecting device 3 according to this embodiment, the state of attachment/removal of the toner container 17Bk is detected by moving the electrically conductive shutter 33 relative to the antenna 312. In relation to a wireless tag communication system using a reader-writer, generally, the provision of an electrically conductive member in the vicinity of the antenna of the reader-writer is considered undesirable for normal data communication. However, in the toner container attachment detecting device 3 according to this embodiment, the shutter 33 is purposely provided in the vicinity of the antenna 312 to improve the accuracy of detecting the state of attachment/removal of the toner container, which is difficult to conceive from a general technique.

Furthermore, in this embodiment, as described previously, the shutter 33 is grounded through the urging member 35 on the apparatus body 11 side. Therefore, when the shutter 33 is located in the covering position, the number of magnetic flux lines of the carrier wave absorbed by the shutter 33 can be increased. Hence, as compared to the case where the shutter 33 is not grounded, the radio field intensity of the carrier wave to be detected by the radio field intensity detecting section 316 can be reduced. As a result, in this embodiment, the determination accuracy in the determining section 317 and, thus, the detection accuracy in the toner container attachment detecting device 3 can be improved.

For example, in the above-described general attachment detecting device, the state of attachment/removal of a toner container may not be able to be accurately detected. Specifically, in the general attachment detecting device, when data communication can be established between the reader-writer and the tag, it is determined that the toner container is attached to the apparatus body. On the other hand, when data communication cannot be established between the reader-writer and the tag, it is determined that the toner container is not attached to the apparatus body. Therefore, in the general attachment detecting device, the state of attachment/removal of the toner container may not be able to be accurately detected. More specifically, when the tag is peeled off from the toner container, the general attachment detecting device makes a wrong determination that the toner container is not attached to the apparatus body, even though the toner container is attached to the apparatus body. Unlike the general attachment detecting device, according to this embodiment, the accuracy of detecting the state of attachment/removal of the toner container can be improved.

The above description has been given of the case where the toner container attachment detecting device according to the present disclosure is applied to an image forming apparatus including four toner containers for different colors. However, the present disclosure is not limited to this and can be applied to, for example, an image forming apparatus including a toner container for a single color or other apparatuses and equipment including one or more toner containers.

Furthermore, although the above description has been given of the case where an abutment member is used as the first displacing portion, the first displacing portion in the present disclosure is not limited to this and may be anything so long as it is provided on the toner container and can displace the shutter from the covering position to the open position when the toner container is attached to the apparatus body.

Moreover, although the above description has been given of the case where an urging member is used as the second displacing portion, the second displacing portion in the present disclosure is not limited to this and may be anything so long as it can displace the shutter from the open position to the covering position when the toner container is removed from the apparatus body.

However, as in the above embodiment, the use of an abutment member and an urging member as the first and second displacing portions, respectively, is preferred from the viewpoint that the mechanism for displacing the shutter can be implemented by a simple structure.

The structures, configurations, and processing described with reference to FIGS. 1 to 7 are merely illustrative of the present disclosure and the present disclosure is not intended to be limited to the above structures, configurations, and processing.

While the present disclosure has been described in detail with reference to the embodiments thereof, it would be apparent to those skilled in the art the various changes and modifications may be made therein within the scope defined by the appended claims.

What is claimed is:

1. A toner container attachment detecting device for use in an image forming apparatus, the toner container attachment detecting device comprising:

a reader-writer that is provided at an apparatus body of the image forming apparatus and performs data communication of predetermined toner information with a tag;

a shutter made with an electrically conductive material and provided movably relative to the apparatus body between an open position where the shutter is kept from influencing a carrier wave radiated from an antenna of the reader-writer and a covering position where the shutter underlies across the antenna to influence the carrier wave radiated from the antenna;

a first displacing portion that is provided on a toner container removably attachable to the apparatus body and capable of containing toner and displaces, upon attachment of the toner container to the apparatus body, the shutter from the covering position to the open position; and a second displacing portion that displaces, upon removal of the toner container from the apparatus body, the shutter from the open position to the covering position, the reader-writer comprising:

the antenna;

a carrier wave generating section that generates a carrier wave to be radiated from the antenna;

a radio field intensity detecting section that detects a radio field intensity of the carrier wave radiated from the antenna; and a determining section that determines, based on a detection result of the radio field intensity detecting section, whether or not the toner container is attached to the apparatus body, wherein the shutter is grounded.

2. The toner container attachment detecting device according to claim 1, wherein when the radio field intensity of the carrier wave detected by the radio field intensity detecting section is larger than a predetermined threshold value, the determining section determines that the toner container is attached to the apparatus body, and when the radio field intensity of the carrier wave detected by the radio field intensity detecting section is equal to or smaller than the predetermined threshold value, the determining section determines that the toner container is removed from the apparatus body.

3. The toner container attachment detecting device according to claim 1, wherein the first displacing portion is an abutment member provided at a location on the toner container where the abutment member abuts on the shutter when the toner container is attached to the apparatus body, the second displacing portion is an urging member that, upon removal of the toner container from the apparatus body, urges the shutter toward the covering position where the shutter faces the antenna of the reader-writer, when the toner container is attached to the apparatus body, the abutment member abuts on the shutter and displaces the shutter from the covering position to the open position according to an operation for attachment of the toner container to the apparatus body and against an urging force of the urging member, and when the toner container is removed from the apparatus body, the urging member urges the shutter to displace the shutter abutting on the abutment member from the open position to the covering position according to an operation for removal of the toner container from the apparatus body.

4. The toner container attachment detecting device according to claim 3, wherein the abutment member is made with a non-electrically conductive material.

5. An image forming apparatus comprising an apparatus body, a toner container removably attached to the apparatus body and capable of containing toner, and an attachment detecting device that detects whether or not the toner container is attached to the apparatus body, wherein the attachment detecting device used is the toner container attachment detecting device according to claim 1, the image forming apparatus further comprises:

a control section; and an image forming section that subjects a recording medium to image formation processing, and the control section controls, when accepting, as a determination result of the determining section of the reader-writer, that the toner container is attached to the apparatus body, to allow the image forming section to perform the image formation processing and controls, when accepting, as a determination result of the determining section of the reader-writer, that the toner container is removed from the apparatus body, to stop the image forming section from performing the image formation processing.

6. A toner container attachment detecting device for use in an image forming apparatus, the toner container attachment detecting device comprising:

a reader-writer provided at an apparatus body of the image forming apparatus;

a tag that is provided on a toner container removably attachable to the apparatus body and capable of containing toner and performs data communication of predetermined toner information with the reader-writer;

a shutter made with an electrically conductive material and provided movably relative to the apparatus body between an open position where the shutter is kept from influencing a carrier wave radiated from an antenna of the reader-writer and a covering position where the shutter underlies across the antenna to influence the carrier wave radiated from the antenna;

a first displacing portion that is provided on the toner container and displaces, upon attachment of the toner container to the apparatus body, the shutter from the covering position to the open position; and a second displacing portion that displaces, upon removal of the toner container from the apparatus body, the shutter from the open position to the covering position, the reader-writer comprising:

the antenna;

a carrier wave generating section that generates a carrier wave to be radiated from the antenna;

a radio field intensity detecting section that detects a radio field intensity of the carrier wave radiated from the antenna; and a determining section that determines, based on a detection result of the radio field intensity detecting section, whether or not the toner container is attached to the apparatus body, wherein the shutter is grounded.

7. The toner container attachment detecting device according to claim 6, wherein when the radio field intensity of the carrier wave detected by the radio field intensity detecting section is larger than a predetermined threshold value, the determining section determines that the toner container is attached to the apparatus body, and when the radio field intensity of the carrier wave detected by the radio field intensity detecting section is equal to or smaller than the predetermined threshold value, the determining section determines that the toner container is removed from the apparatus body.

8. The toner container attachment detecting device according to claim 6, wherein the first displacing portion is an abutment member provided at a location on the toner container where the abutment member abuts on the shutter when the toner container is attached to the apparatus body, the second displacing portion is an urging member that, upon removal of the toner container from the apparatus body, urges the shutter toward the covering position where the shutter faces the antenna of the reader-writer, when the toner container is attached to the apparatus body, the abutment member abuts on the shutter and displaces the shutter from the covering position to the open position according to an operation for attachment of the toner container to the apparatus body and against an urging force of the urging member, and when the toner container is removed from the apparatus body, the urging member urges the shutter to displace the shutter abutting on the abutment member from the open position to the covering position according to an operation for removal of the toner container from the apparatus body.

9. The toner container attachment detecting device according to claim 8, wherein the abutment member is made with a non-electrically conductive material.

10. An image forming apparatus comprising an apparatus body, a toner container removably attached to the apparatus body and capable of containing toner, and an attachment detecting device that detects whether or not the toner container is attached to the apparatus body, wherein the attachment detecting device used is the toner container attachment detecting device according to claim 6, the image forming apparatus further comprises:

a control section; and an image forming section that subjects a recording medium to image formation processing, and the control section controls, when accepting, as a determination result of the determining section of the reader-writer, that the toner container is attached to the apparatus body, to allow the image forming section to perform the image formation processing and controls, when accepting, as a determination result of the determining section of the reader-writer, that the toner container is removed from the apparatus body, to stop the image forming section from performing the image formation processing.

* * * * *